US009455527B2

(12) United States Patent
Briccarello

(10) Patent No.: US 9,455,527 B2
(45) Date of Patent: Sep. 27, 2016

(54) CONNECTOR HOUSING

(71) Applicant: TYCO ELECTRONICS AMP Italia SRL, Collegno (Turin) (IT)

(72) Inventor: Alessandro Briccarello, Turin (IT)

(73) Assignee: Tyco Electronics AMP Italia SRL, Collegno, Turin (IT)

( * ) Notice: Subject to any disclaimer, the term of this patent is extended or adjusted under 35 U.S.C. 154(b) by 0 days.

(21) Appl. No.: 14/349,657

(22) PCT Filed: Oct. 1, 2012

(86) PCT No.: PCT/EP2012/069334
§ 371 (c)(1),
(2) Date: Apr. 3, 2014

(87) PCT Pub. No.: WO2013/050321
PCT Pub. Date: Apr. 11, 2013

(65) Prior Publication Data

US 2014/0273604 A1 Sep. 18, 2014

(30) Foreign Application Priority Data

Oct. 4, 2011 (IT) ..... VI2011A02654

(51) Int. Cl.
*H01R 13/64* (2006.01)
*H01R 13/629* (2006.01)
(Continued)

(52) U.S. Cl.
CPC ..... *H01R 13/629* (2013.01); *H01R 13/516* (2013.01); *H01R 13/6397* (2013.01); *H01R 13/645* (2013.01)

(58) Field of Classification Search
CPC ..... H01R 13/629; H01R 13/6397; H01R 13/516; H01R 13/645; H01R 13/639
USPC ..... 439/374
See application file for complete search history.

(56) References Cited

U.S. PATENT DOCUMENTS 4,036,544 A * 7/1977 Keglewitsch ..... 439/350
2003/0190830 A1 10/2003 Tanaka et al.
(Continued)

FOREIGN PATENT DOCUMENTS

CA 2628986 10/2009

OTHER PUBLICATIONS

International Search Report and Written Opinion issued by the European Patent Office, dated Nov. 15, 2012, for International Application No. PCT/EP2012/069334; 11 pages.
(Continued)

*Primary Examiner* — Javaid Nasri
(74) *Attorney, Agent, or Firm* — Faegre Baker Daniels LLP

(57) ABSTRACT

The present invention relates to a socket housing and to a plug housing for use in an electrical connector. A connection face of the socket housing has a recess, at the base of which one or more guide cones are formed, which connect the outer surface of the connection face to one or more corresponding insertion channels in which the electrical contacts of the socket housing are housed. The plug housing includes a protrusion, on which the contact pins are arranged. The protrusion is shaped in section such that it can enter the recess in the connection face of the socket housing. Since the connection pins are not formed directly on a connection face of the socket housing, but on the protrusion, even pins having a length shorter than that of conventional pins can easily reach the electrical contacts in the socket housing and can establish a reliable electrical connection.

15 Claims, 5 Drawing Sheets

(51) Int. Cl.

| | |
|---|---|
| ***H01R 13/516*** | (2006.01) |
| ***H01R 13/639*** | (2006.01) |
| *H01R 13/645* | (2006.01) |

(56) References Cited

U.S. PATENT DOCUMENTS

| | | | |
|---|---|---|---|
| 2005/0090153 | A1 | 4/2005 | Brochu et al. |
| 2008/0139029 | A1 | 6/2008 | Tsuji et al. |

OTHER PUBLICATIONS

Rapporto Di Ricerca (Research Report) issued by the Ministero dello Sviluppo Economico (Ministry of Economic Development), dated Mar. 22, 2012, for related Application No. IT VI20110265; 9 pages.

International Preliminary Report on Patentability issued by the International Bureau of WIPO, Geneva, Switzerland, dated Apr. 8, 2014, for International Application No. PCT/EP2012/069334; 7 pages.

* cited by examiner

CONNECTOR HOUSING

The present invention relates to electrical connectors. In particular, the present invention relates to a connection assembly for use in a housing for electrical contacts, said connection assembly comprising a guide cone for insertion of a contact pin. The present invention also relates to a housing for contact pins, said housing comprising a pin adapted for coupling to the connection assembly via a housing for electrical contacts.

BACKGROUND

Connectors comprise a header for contact pins, normally referred to as a plug, and a housing for electrical contacts, called a socket, adapted for coupling to the plug. According to conventional designs, the contact pins are arranged along the connection face of the socket, of which the surface is substantially flat. The housing for the electrical contacts used as a counterpart of the header for pins has a connection face comprising one or more insertion holes arranged correspondingly to the contact pins. Such holes are normally funnel-shaped so as to facilitate insertion of the contact pins and are arranged on the substantially flat surface of the connection face of the housing for electrical contacts.

The thickness of the walls of the housing for electrical contacts is selected so as to meet specific requirements, such as resistance to mechanical and thermal stress, or other physical constraints. The thickness of the connection face of the housing for sockets known from the prior art normally varies approximately from 0.70 mm to 0.80 mm. In addition, when the socket and the plug of the connector are fully connected, safety protrusions prevent contact between the connection faces of the socket and of the plug. The distance between the connection face of the socket housing and the connection face of the plug housing may generally vary between 0.70 mm and 0.80 mm.

Normally, to ensure a secure, lasting connection between the contact pins of the socket and the electrical contacts of the plug, a minimum brush surface between the pins and electrical contacts is ensured. Generally, the minimum brush surface required is 1 mm. To obtain the minimum guaranteed brush surface between pins and electrical contacts, the header is designed so as to comprise pins having a length of approximately 8 mm or greater.

A disadvantage of the connector housings described above is that, to ensure a reliable connection between the electrical contacts and pins, the pins have to be extremely long. Pins of such dimensions are subject to excessive deflection during and after the connection process. This exposes the pins to stress, which could cause them to break and could also reduce the quality and reliability of the electrical contact. In addition, the effects of any errors in the angle of insertion of the pins increase with the length of the pins themselves. Consequently, the permitted tolerance of the connection of the connector has to be reduced considerably, which complicates, and therefore increases the costs of, the design of additional components of the connector, such as lever mechanisms used to push the header for pins toward its counterpart.

SUMMARY

The object of the present invention is therefore to develop a connector, and in particular a design for housings for contact pins and for a contact assembly, which is economical, versatile, and which makes it possible to minimize the deflection of the pins and the effects caused by errors in the angle of insertion of the pins, whilst maintaining the brush contact between the pins and the electrical contacts.

This object is achieved by modifying the structure of the housing for pins and of the housing for the corresponding electrical contacts so as to reduce the length of the pins without reducing the brush contact between the pins of a header and any corresponding electrical contacts arranged in the contact assembly.

In particular, in accordance with an advantageous embodiment, the present invention relates to a connection assembly to be used in a housing for electrical contacts. The connection assembly comprises at least one guide cone for insertion of a contact pin or, more generally, a male contact, wherein the guide cone is arranged in a recess in a connection face of the connection assembly. The recess can be coupled with a corresponding protrusion of a housing for male contacts.

This design makes it possible to use a counterpart having male contacts, such as contact pins or fins, of reduced length, simultaneously ensuring a minimum brush surface between pins and electrical contacts, which is necessary in order to achieve a reliable electrical connection. The possibility of using a counterpart having pins or tongues of reduced length also has a positive effect on the quality of the electrical contact and reduces considerably the negative effects caused by an improper angle of insertion. The connection assembly may comprise a connection face and a female contact housing, or can be a casing to be assembled on housings for contacts of a known design which anticipates the use of an inner housing and an outer casing. The connection assembly of the present invention may therefore be used to update housings for female contacts already in use.

In accordance with a further embodiment, the connection assembly could comprise an inner housing adapted to house electrical contacts and an outer casing adapted for assembly on the inner housing, wherein the recess and the guide cone are formed on a face of the outer casing.

In this embodiment, the connection face comprising the recess and the entry cone is formed on the outer casing. The design can easily be adapted for use in known connectors which use an inner housing for contacts and an outer casing. Furthermore, this design is more versatile and makes the connection assembly easier to handle. This is particularly advantageous in applications requiring connectors of reduced size. The present invention therefore makes it possible to use a connector formed of two parts, said connector therefore being versatile and easy to handle, and at the same time makes it possible to reduce the overall thickness of the face of the connection assembly and therefore the length of the pins of a counterpart thereof, whilst maintaining the contact area between the contacts of the connection assembly and the pins of the counterpart.

The inner housing could comprise at least one insertion channel or contact-carrying channel, an entry hole of the insertion channel being aligned with the at least one guide cone.

In an advantageous embodiment of the present invention, a portion of the face of the inner housing surrounding the at least one insertion channel may have a substantially flat surface.

The contact-carrying channel thus extends via an entry hole in the entry surface of the inner housing so as to coincide with the hole of a guide cone. It is thus possible to reduce the thickness past which the male contacts have to extend before they can contact the electrical contacts arranged in the contact-carrying channel.

In a further embodiment of the present invention, the connection assembly comprises at least two adjacent guide cones and the thickness of the connection face between the guide cones is less than the thickness of the connection face surrounding the guide cones.

In an advantageous embodiment of the present invention, the connection assembly further comprises at least one security element adapted for coupling to a counterpart on the housing for male contacts.

The security element could be a groove or a protrusion.

In an advantageous embodiment of the present invention, the outer casing may comprise two mutually opposed side walls, each of the two walls having a mechanical polarization element.

The mechanical polarization element divides the outer casing into two asymmetrical parts and can be coupled to a counterpart on the inner housing, thus guiding the outer casing in such a way that it is assembled correctly on the inner housing.

In an advantageous embodiment of the present invention, the recess is substantially trapezoidal in section.

In a further advantageous embodiment of the present invention, the inner housing further comprises electrical contacts arranged inside the contact-carrying channel. The electrical contacts are adapted to establish an electrical connection to male contacts of a corresponding housing for male contacts.

The present invention further relates to a male housing for use in a connector, said male housing comprising a connection surface and at least one connection pin. The connection surface may have a protrusion, which can be coupled to a corresponding recess in a connection face of a housing for electrical contacts. The connection pin can be inserted into an insertion channel of the housing for electrical contacts, and is positioned on the protrusion of the connection surface.

Since, in the male housing of the present invention, the contact tongues or pins are formed on a protrusion, the length of the male contacts can be reduced considerably without reducing the brush contact between male contacts and the electrical contacts housed in a counterpart. Short male contacts provide greater resistance to lateral forces, such as those exerted by the electrical contacts of the counterpart, thus having a positive effect on the quality of the electrical contact. Male contacts of reduced length also reduce considerably the negative effects caused by an improper angle of insertion.

In an advantageous embodiment, the housing for pins may further comprise at least one security element adapted for coupling with a counterpart on the housing for electrical contacts.

In a further advantageous embodiment, the security element is a groove or a protrusion.

In a further advantageous embodiment, the protrusion is substantially trapezoidal in section.

The present invention lastly relates to a connector for an electric circuit, said connector comprising the connection assembly and the housing for contact pins described above.

The accompanying figures are incorporated in the detailed description and form part of said description for the purpose of illustrating various embodiments of the present invention. These figures are used to explain the principles of the invention together with the description. The sole purpose of the figures is to illustrate preferred and alternative embodiments showing how the invention can be implemented and used, and are not to be interpreted as limiting the invention to those examples illustrated and described. Additional characteristics and advantages will become clear from the more detailed description below of the various embodiments of the invention, as illustrated in the accompanying figures and in which:

In the following description, for explanatory purposes, specific details are provided so as to enable correct comprehension of the invention. However, it is evident that the present invention can be implemented without such specific details. In addition, well-known structures and components are only described generally so as to facilitate the description thereof.

In addition, the term "housing for electrical contacts" used hereinafter refers to a female housing, whereas the term "male housing" refers to a counterpart of the housing for electrical contacts, said counterpart comprising connection pins or tongues adapted for connection to the electrical contacts in the female housing. Lastly, the recess formed in the connection face of the female connector may be a blind bore formed in the thickness of the connection face.

The problem addressed by the present invention is based on the observation that conventional designs of connector units comprising male and female housings require the use of male connectors, such as connection pins or tongues, which exceed 8 mm in length so as to ensure the required minimum contact between electrical contacts and pins. Pins of such a length are subject to deflection, which reduces the quality of the electrical connection between the pins and the contacts housed in the receptacle for female contacts. Given their length, the male contacts housed in conventional male receptacles are also subject to breakages, particularly during the phase of connection of the connector unit. During the phase of connection of the connector unit in particular, errors in the angle of insertion of the male contacts into the insertion channels of the female housing may cause breakages or damage to the contacts themselves. The effects caused by errors in the angle of insertion increase with the length of the male contacts. In accordance with the present invention, a connection face of the female housing or of a connection assembly of the female housing has a recess, at the base of which one or more guide cones are formed, which connect the outer surface of the connection face to one or more corresponding insertion channels in which the electrical contacts of the female housing are housed. This embodiment makes it possible to reduce the thickness of the connection face in the region where the guide channels are arranged. The male housing used as a counterpart comprises a protrusion on which the contact pins are arranged. The protrusion is shaped in section such that it can enter the recess in the connection face of the female housing. Since the connection pins are not formed directly on a connection face of the male housing, but on a protrusion, even pins having a length shorter than that of conventional pins can easily reach the electrical contacts in the female housing and can establish a reliable electrical connection.

DETAILED DESCRIPTION OF THE DRAWINGS

Figure 1:
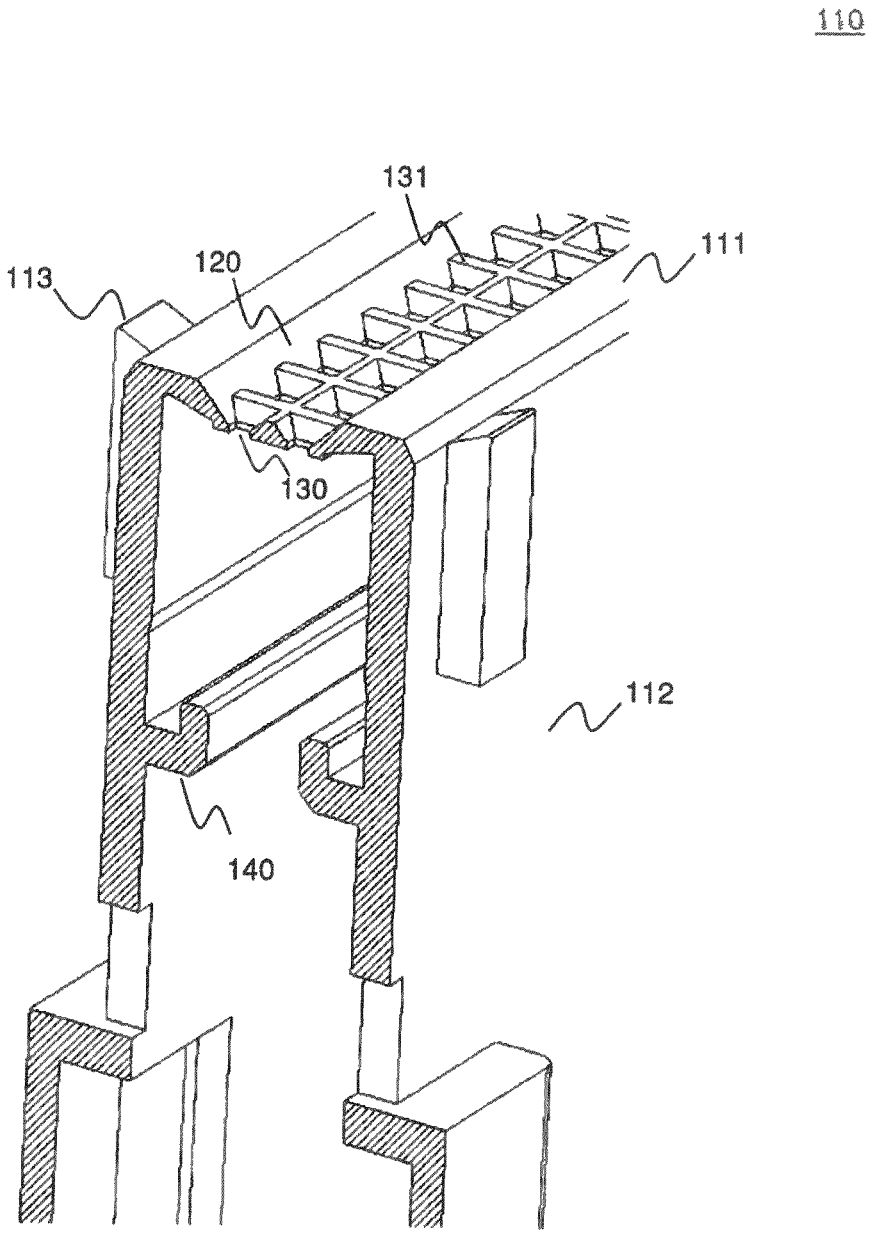
FIG. 1 shows a perspective view of an outer casing in accordance with an embodiment of the present invention.

FIG. 1 shows a perspective view of an outer casing 110 in accordance with an embodiment of the present invention.

The outer casing 110 comprises a connection face 111 and two mutually opposed side walls 112 which are perpendicular to the connection face 111. In its centre, the connection face 111 comprises a recess 120, at the base of which two rows of guide cones 130 are formed. The edges 131 of each guide cone 130 are lowered in relation to the surface of the connection face 111. Consequently, the thickness of the edges of the guide cones is less than the average thickness of the connection face 111. In particular, the thickness of the connection face between the two rows of guide cones is less than the thickness of a portion of the connection face 111 surrounding the two rows of guide cones 130.

The connection face 111 further comprises two indentations 113 positioned one on each side of the recess 120 and extending over the entire length of the connection surface. The indentation 113 has the function of a "Koshiri" element and is adapted for engagement on a corresponding counterpart (not shown) contained in a male housing (not shown). The indentation 113 and its counterpart can be engaged in just one way and only when the female housing is positioned correctly in relation to its counterpart, thus preventing the female housing and its counterpart from being connected incorrectly.

The outer casing 110 further comprises, on each of the side walls 112, a hook 140, which extends inside the outer casing 110 toward an inner housing, which can be assembled on the outer casing 110. The hook 140 can be inserted into a corresponding hooking hole (not shown) in a side wall of the inner housing. The hook 140 is positioned on the side wall 112 so as to divide the side wall 112 into two asymmetrical portions. In addition to fixing the outer casing 110 to the inner housing, the hook 140 thus also provides the function of mechanical polarization. The mechanical polarization defines a single possible direction of assembly and thus prevents the outer casing 110 from being assembled on the inner housing in any other way.

The outer casing 110 may also be used as a connection assembly to be assembled on housings for known contacts designed so as to anticipate the use of an inner housing and an outer casing. In particular, the outer casing 110 of the present invention can be adapted and used to update housings for female contacts already in use.

Figure 2:
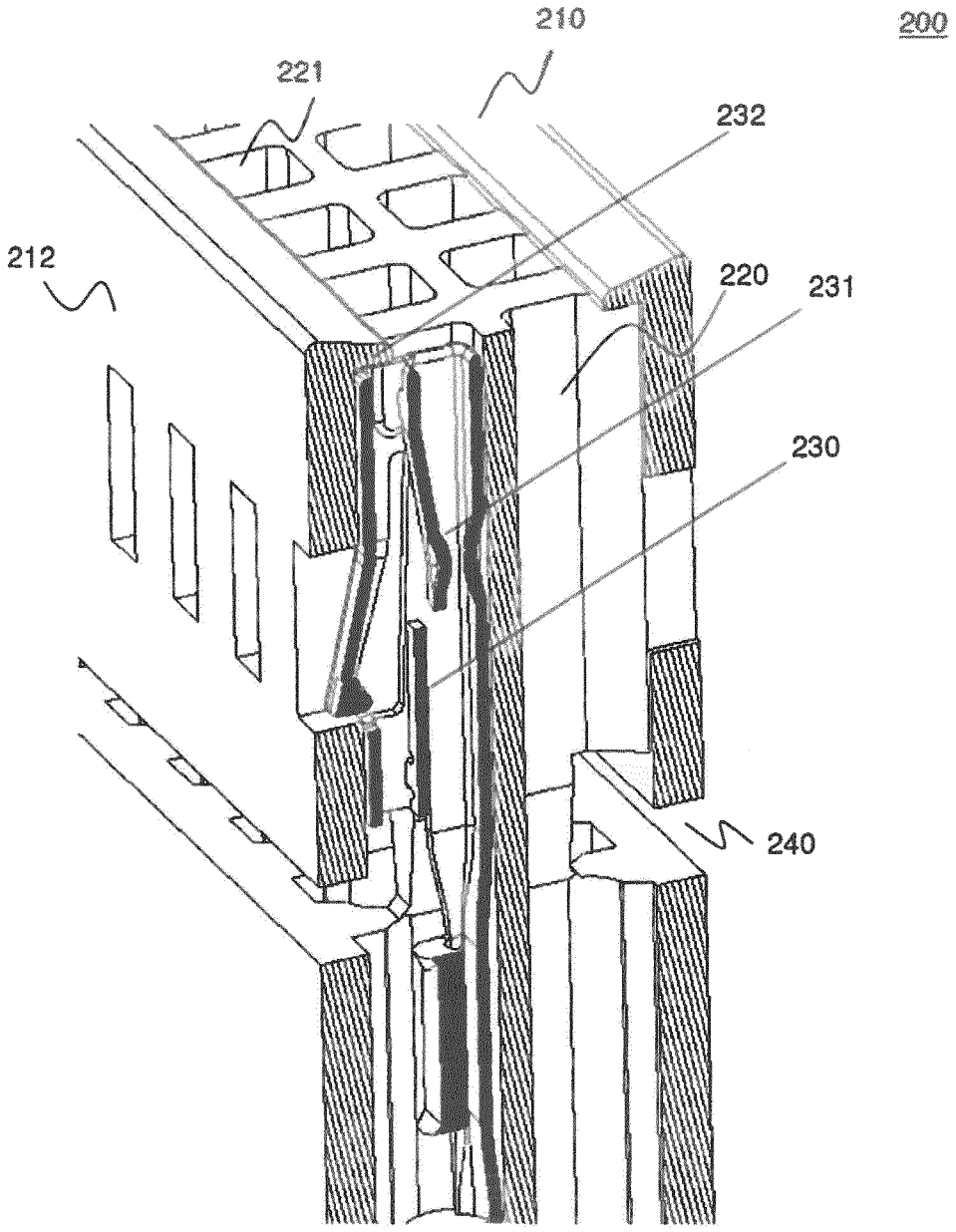
FIG. 2 shows a perspective view of an inner housing for electrical contacts in accordance with an embodiment of the present invention.

FIG. 2 shows a perspective view of an inner housing 200 for electrical contacts in accordance with an embodiment of the present invention.

The inner housing for female contacts comprises two rows of insertion channels 220, or contact-carrying channels, arranged in such a way that each of the insertion channels 220 corresponds to a respective guide cone 130 once the outer casing 110 is assembled on the female housing 200. Each of the insertion channels 220 has an entry hole 221 coinciding with the lower hole of the guide cone 130, "lower hole" meaning the hole of the guide cone facing toward the female housing 200. Electrical contacts 230 are fixed to the walls of each insertion channel 220. Each of the electrical contacts 230 comprises a portion 231 which projects toward the central part of the insertion channel 220 and is adapted for resilient displacement toward a wall of the insertion channel 220.

For example, the portion of the electrical contact 230 projecting toward the central part of the insertion channel 220 may be a metal fin 231, which, when displaced, can return to its initial position. When the connector assembly is fully connected, each of the male contacts, for example a pin, is arranged inside the insertion channel of the female housing. In this embodiment, the pins push the metal fins 231 toward the walls of the insertion channel. The pressure exerted by the metal fins 231 onto the pins ensures physical contact with the pins.

Each of the side walls 212 comprises, in line with the end corresponding to the entry face 210, a contact stop 232 which extends perpendicular to the side wall 212 toward the entry holes 221 of the contact-carrying channels 220. The contact stop 232 covers the entry holes 221 in part so as to block the contacts 230 in the contact-carrying channels 220.

The embodiment of the female housing 200 of the present invention allows the use of short pins in the male housing. Short pins are subjected to less deflection when pressed by the metal fins 231 housed in the female receptacle 200, thus ensuring a reliable electrical connection.

The inner housing 200 is rectangular in section and comprises two side walls 212. Each of the side walls 212 comprises a hooking hole or fixing hole 240 adapted for cooperation with the hook 140. The fixing hole 240 is arranged in such a position in the side wall 212 that it divides the side wall 212 into two asymmetrical parts. The fixing hole 240, together with the hook 140 formed on the lateral wall 112 of the outer casing 110, helps to fix the outer casing 110 on the inner housing 200. In addition, the fixing hole 240 is also used for mechanical polarization. The mechanical polarization defines a single possible direction of assembly and thus prevents the outer casing 110 from being assembled on the inner housing 200 in any other way.

Although the inner housing 200 is rectangular in section, the present invention is not limited to this embodiment, and the inner housing may be of any shape in section, for example square or circular. Consequently, the outer casing may have any cross-sectional shape allowing it to be assembled on the inner housing.

Figure 3:
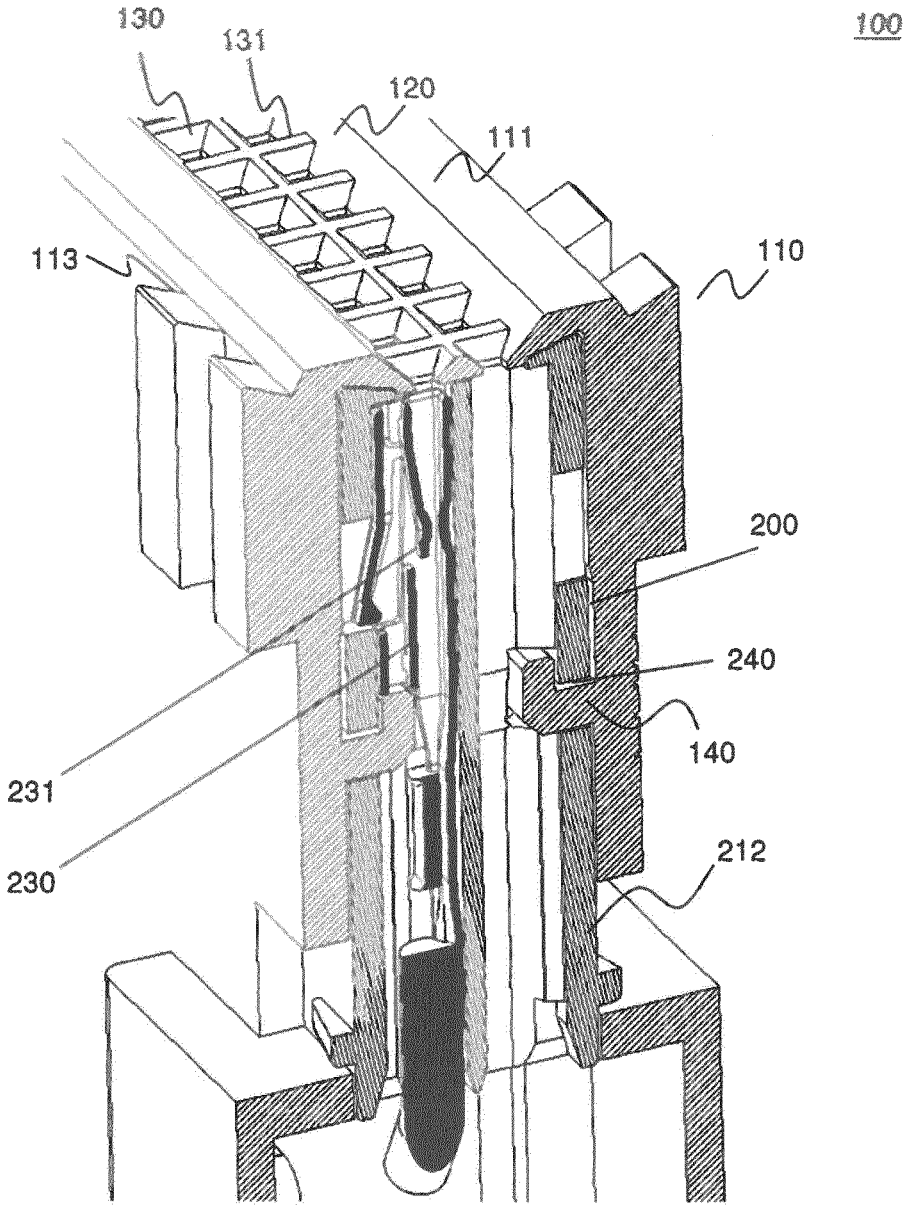
FIG. 3 shows a perspective view of a unit for a female housing for electrical contacts, formed from an outer casing and from an inner housing in accordance with an embodiment of the present invention.

FIG. 3 shows a perspective view of a unit for a female housing 100 for electrical contacts, said unit being formed by the outer casing 110 and by the inner housing 200 in accordance with an embodiment of the present invention.

The outer casing 110 is positioned such that the lower face of the connection surface 111 rests against the entry face 210 of the inner housing.

The contact-carrying channel 220 thus extends, via the entry hole 221, directly onto the lower face of the connection surface 111 of the outer casing 110. The inner contact housing 200 is therefore devoid of guide cones and has a substantially flat entry face 210. This embodiment helps to reduce the overall thickness of the connection face of the female housing 100 obtained by assembling the outer casing 110 on the inner housing 200.

The hook 140 is inserted into the fixing hole 240 so as to fix the outer casing 110 to the inner housing 200 in a stable manner. The hook 140 is also used as a secondary stop hook. Once inserted into the fixing hole, the hook 140 is arranged below the electrical contact 230 inserted into the contact-carrying channel 220. In this embodiment, the hook 140 therefore also provides additional retention, which prevents the contact 230 from moving, for example as a result of mechanical stresses.

Although the female housing 100 has been described as being formed by two separate parts, in particular by an inner housing 200 and by an outer casing 110, the advantages described with reference to this embodiment can also be achieved using a female housing formed by a single element. In particular, the outer casing 110 and the inner housing 200 could, for example, be formed in one piece in a single element having a connection face comprising a recess, on the base of which guide cones communicating directly with respective contact-carrying channels are formed.

Figure 4:
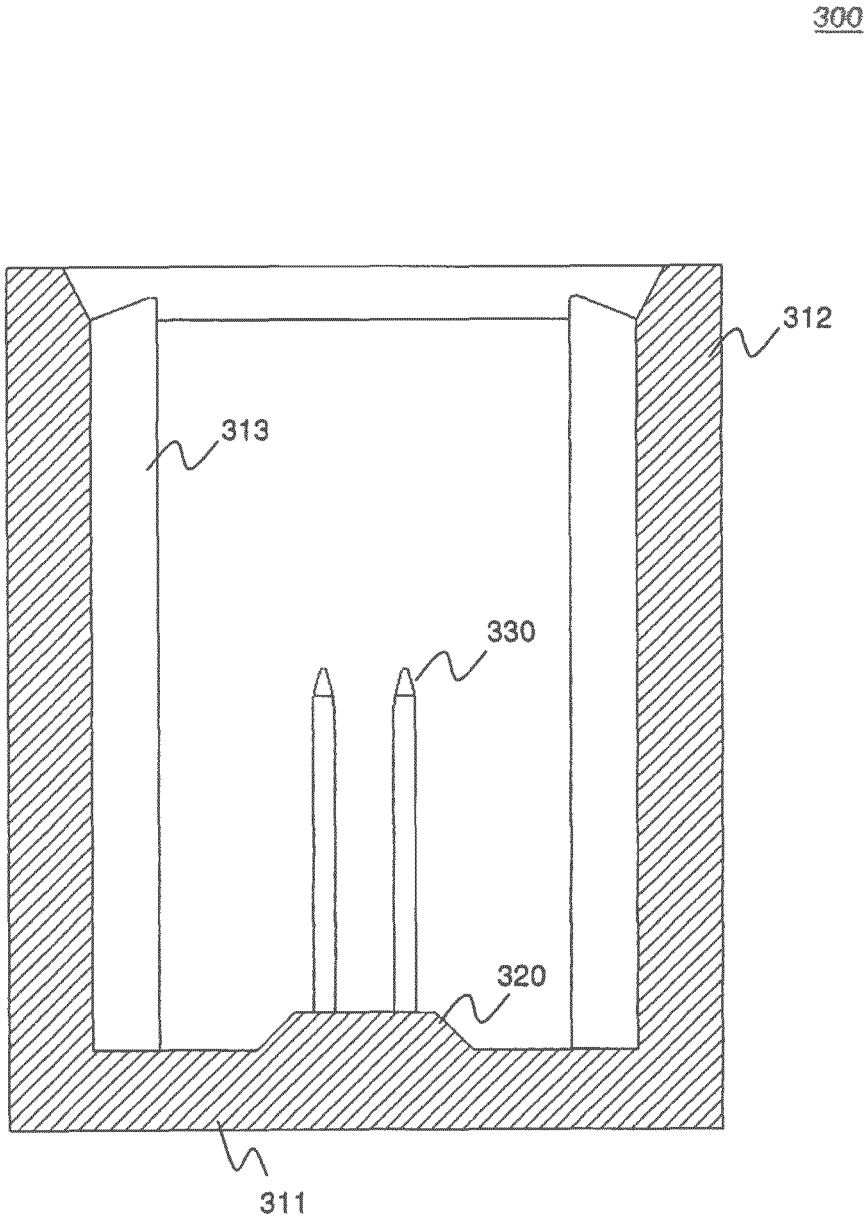
FIG. 4 shows a sectional view of a housing for pins in accordance with an embodiment of the present invention.

FIG. 4 shows a sectional view of a housing for pins in accordance with an embodiment of the present invention.

The housing for pins, or header, 300 comprises two side walls 312 and a connection base 311 adapted for coupling to the connection face 111 of the housing for female contacts 100. The connection base 311 comprises a protrusion 320 arranged in such a way that it coincides with the recess 120 in the connection face 111. The protrusion 320 is trapezoidal in section, and a surface of the protrusion 320 comprises a plurality of contact pins arranged over two rows such that, when the female housing 100 is positioned correctly in relation to the header, each of the pins 330 is aligned with a corresponding guide cone 130.

The header 300 further comprises two Koshiri elements 313 arranged on the connection base or surface 311 in line with the height between each of the side walls 312 and the connection base 311. The Koshiri elements 313 may extend over the entire length of the header, terminate in a cusped manner, and are arranged so as to engage in the notches 113 in the connection face 111.

Figure 5:
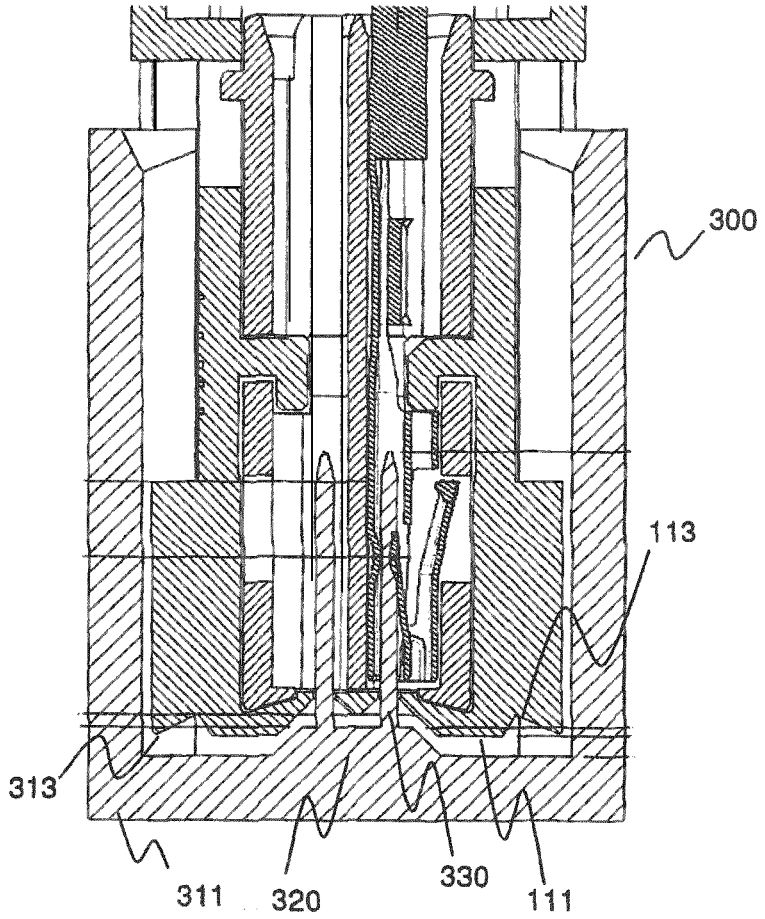
FIG. 5 shows a sectional view of a connector unit comprising a housing for electrical contacts and a housing for male contacts, connected fully, in accordance with an embodiment of the present invention.

The cusped elements 313 and the notches 113 can be engaged in just one way and merely when the female housing is positioned correctly in relation to its counterpart, thus preventing the female housing and its counterpart from being connected incorrectly, even with an incorrect inclination, thus protecting the pins in the event of incorrect or accidental coupling of the female and male housings. FIG. 5 shows a sectional view of a connector unit comprising a housing for electrical contacts and a housing for male contacts, said housings being fully connected in accordance with an embodiment of the present invention.

When the female housing 100 is fully inserted into the header 300 for pins, the notches 113 in the connection face 111 engage the cusped elements 313 in such a way that at least one face of each of the cusped elements 313 fully abuts a portion of the connection face 111 such that the cusped element engages the notch 113 over its entire height. This embodiment prevents the female housing 100 from moving in relation to the header 300, thus preventing damage to the connection pins 330 and to the contacts 230 housed in the female housing 100. The Koshiri elements also help to create a space, for example measuring 0.50 mm, between the connection base 311 and the connection face 111.

The protrusion 320 formed on the connection base 311 is raised with respect to the connection base 311. The header 300 and the female housing can be designed in such a way that, when fully connected, the protrusion 320 carrying the pins is inserted into the recess 120 in the outer casing 110, at least in part. This embodiment thus makes it possible to shorten the length of the connection pins 330, whilst maintaining the length of clean contact between the contacts 230 of the female housing and the pins 330.

In particular, in the embodiment illustrated in FIG. 5, the protrusion 320 is raised with respect to the connection base 311 by 0.7-0.8 mm, which makes it possible to shorten the length of the connection pins 330 by at least 0.7-0.8 mm. Since the guide cones 130 are formed in the recess 120 in the outer casing 110 and the connection pins 330 are arranged on the protrusion 320, which is adapted for partial insertion into the recess 120, the base of the connection pins 330 is at a distance of 0.3 mm from the guide cone and at approximately 0.8 mm from the entry hole 221. In a conventional connector however, the minimum distance between the base of the connection pins and the entry holes in the female housing is greater than 1.5 mm.

Although the Koshiri elements described with reference to the figures above are a cusped element and a notch, the present invention is not limited to this embodiment, and Koshiri elements can be of any form adapted to the purpose.

To conclude, the design of the female housing 100 and of the header 300 for pins according to the present invention makes it possible to use contact pins 330 having a length of approximately 6.5 mm, compared to approximately 8 mm in the case of conventional pins, and, at the same time, makes it possible to have a minimum brush contact required to achieve a reliable electrical connection. Such minimum brush contact is generally 1 mm. In the embodiment shown in FIG. 5, the brush contact between the pins 330 and the contacts 230 in the female housing 100 is 1.8 mm, and therefore much longer than the minimum brush contact required.

The example described with reference to FIG. 5 is intended to illustrate a specific application of the concept of the present invention and the advantages associated therewith. However, it will be appreciated that the specific details, in particular the measurements, disclosed in this example are in no way limiting and can change according to the type of connector and to the application in which said connector is used.

Although in the embodiments described above reference is made explicitly to contact pins, this must not be considered to be limiting to the present invention, which can be implemented using any type of male contact, such as contact fins and the like.

In conclusion, the connection assembly for female contacts and the housing for pins according to the present invention make it possible to maximize the brush contact whilst reducing the length of the contact pins. This is particularly useful for connectors of the Nano MQS type, in which the contact pins must have very reduced dimensions, normally 0.4×0.5 mm. In addition, the possibility of having pins of reduced length makes it possible to simplify the construction of the male housing.

| Reference number | Description |
|---|---|
| 100 | female housing |
| 110 | outer casing |
| 111 | connection face |
| 112 | side wall of the outer casing |
| 113 | Koshiri element |
| 120 | recess |
| 130 | guide cone |
| 131 | edges of the guide cone |
| 140 | hook for mechanical polarisation |
| 200 | inner housing |
| 210 | entry face |
| 212 | side wall of the inner housing |
| 220 | contact-carrying channel |
| 221 | entry hole of the insertion channel |
| 230 | female contacts |
| 231 | metal fin |
| 232 | contact stop |
| 240 | fixing hole |
| 300 | housing for pins |
| 311 | connection base |

-continued

| Reference number | Description |
|---|---|
| 312 | side walls |
| 313 | Koshiri element |
| 320 | protrusion |
| 330 | contact pin |

The invention claimed is:

1. A female housing for electrical contacts, comprising:

at least one guide cone for insertion of a contact pin; wherein the guide cone is arranged in a recess, said recess being able to be coupled with a corresponding protrusion of a housing for male contacts;

an inner housing adapted to house electrical contacts; and an outer casing adapted for assembly at the inner housing, wherein the recess and the guide cone are formed on a connection face of the outer casing.

2. The female housing according to claim 1, wherein the inner housing comprises at least one contact carrying channel, an entry hole of the contact carrying channel being aligned with the at least one guide cone.

3. The female housing according to claim 2, wherein a portion of an entry face of the inner housing surrounding the at least one contact-carrying channel has a substantially flat surface.

4. The female housing according to claim 2, further comprising electrical contacts arranged inside the contact-carrying channel and adapted to establish an electrical connection with the contact pin of a corresponding housing for male contacts.

5. The female housing according to claim 1, wherein the outer casing further comprises two mutually opposed side walls, each of the two side walls having a mechanical polarization element.

6. The female housing according to claim 1, wherein the female housing comprises at least two adjacent guide cones, and wherein the thickness of the connection face between the guide cones is less than the thickness of the connection face surrounding the guide cones.

7. The female housing according to claim 1, further comprising at least one security element adapted for coupling to a counterpart on the housing for male contacts.

8. The female housing according to claim 7, wherein the security element is a groove or a protrusion.

9. The female housing according to claim 1, wherein the recess is substantially trapezoidal in section.

10. A connector for an electric circuit, said connector comprising:

a female housing for female contacts, comprising:

at least one guide cone for insertion of a contact pin; wherein the guide cone is arranged in a recess in a connection face of the female housing for female contacts,; and a male housing for male contacts, comprising:

a connection surface having a protrusion which can be coupled to the recess in the connection face of the female housing for female contacts; and at least one male contact, which can be inserted into an insertion channel of the female housing for female contacts, wherein the at least one male contact is positioned on the protrusion of the connection surface, and a base of the male contact is within the recess upon connection.

11. The housing according to claim 10, further comprising at least one security element adapted for coupling with a counterpart on the housing for electrical contacts.

12. The housing according to claim 11, wherein the security element is a groove or a protrusion.

13. The housing according to claim 10, wherein the base of the male contacts is at a distance of less than 0.5 mm from the guide cone.

14. The housing according to claim 13, wherein the base of the male contacts is at a distance of approximately 0.3 mm from the guide cone.

15. The housing according to claim 10, wherein the protrusion on the connection surface is substantially trapezoidal in section.

* * * * *